US008523706B2

(12) United States Patent
Cole et al.

(10) Patent No.: US 8,523,706 B2
(45) Date of Patent: Sep. 3, 2013

(54) GOLF CLUB HEAD HAVING A HOLLOW RAIL MEMBER

(75) Inventors: Eric V. Cole, Phoenix, AZ (US); Randall B. Noble, Phoenix, AZ (US); Jeff A. Blankenship, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 88 days.

(21) Appl. No.: 12/482,437

(22) Filed: Jun. 10, 2009

(65) Prior Publication Data

US 2010/0317453 A1 Dec. 16, 2010

(51) Int. Cl.
*A63B 53/04* (2006.01)

(52) U.S. Cl.
USPC ..... 473/346; 473/349; 473/350

(58) Field of Classification Search
USPC ..... 473/324–350
See application file for complete search history.

(56) References Cited

U.S. PATENT DOCUMENTS

| | | | | | |
|---|---|---|---|---|---|
| 3,955,820 | A | * | 5/1976 | Cochran et al. | 473/337 |
| 4,645,207 | A | * | 2/1987 | Teramoto et al. | 473/290 |
| 4,921,252 | A | * | 5/1990 | Antonious | 473/242 |
| 4,955,610 | A | * | 9/1990 | Creighton et al. | 473/332 |
| 5,011,151 | A | * | 4/1991 | Antonious | 473/242 |
| 5,335,914 | A | * | 8/1994 | Long | 473/350 |
| 5,409,229 | A | | 4/1995 | Schmidt | |
| 5,419,560 | A | * | 5/1995 | Bamber | 473/350 |
| 5,472,203 | A | | 12/1995 | Schmidt | |
| 5,482,279 | A | * | 1/1996 | Antonious | 473/327 |
| 5,536,011 | A | * | 7/1996 | Gutowski | 473/350 |
| 5,540,437 | A | * | 7/1996 | Bamber | 473/327 |
| 5,616,088 | A | * | 4/1997 | Aizawa et al. | 473/341 |
| 5,669,830 | A | * | 9/1997 | Bamber | 473/350 |
| 6,080,069 | A | * | 6/2000 | Long | 473/332 |
| 6,083,118 | A | | 7/2000 | Martins | |
| 6,086,485 | A | * | 7/2000 | Hamada et al. | 473/329 |
| 6,210,290 | B1 | | 4/2001 | Erickson | |
| 6,344,001 | B1 | * | 2/2002 | Hamada et al. | 473/329 |
| 7,022,027 | B2 | * | 4/2006 | Chen | 473/291 |
| 7,077,763 | B2 | * | 7/2006 | Wahl et al. | 473/334 |
| 7,083,531 | B2 | | 8/2006 | Aguinaldo | |
| 7,128,663 | B2 | | 10/2006 | Bamber | |
| 7,153,219 | B2 | * | 12/2006 | Reed et al. | 473/290 |
| 7,410,424 | B2 | * | 8/2008 | Chen | 473/291 |
| 2002/0107087 | A1 | * | 8/2002 | Fagot | 473/291 |
| 2004/0204263 | A1 | | 10/2004 | Fagot | |
| 2005/0255938 | A1 | * | 11/2005 | Soracco | 473/345 |
| 2006/0052183 | A1 | * | 3/2006 | Soracco et al. | 473/345 |
| 2006/0052184 | A1 | * | 3/2006 | Soracco et al. | 473/345 |
| 2006/0199661 | A1 | | 9/2006 | Deng | |

FOREIGN PATENT DOCUMENTS

| | | | |
|---|---|---|---|
| JP | 07213656 | A * | 8/1995 |
| JP | 09271544 | A * | 10/1997 |
| JP | 10314348 | A * | 12/1998 |
| JP | 11226158 | A * | 8/1999 |
| JP | 2000153008 | A * | 6/2000 |
| JP | 2002177422 | A * | 6/2002 |
| JP | 2003062135 | A * | 3/2003 |
| JP | 2004215724 | A * | 8/2004 |
| JP | 2006122544 | A * | 5/2006 |
| JP | 2006212066 | A * | 8/2006 |
| JP | 2009226062 | A * | 10/2009 |

* cited by examiner

*Primary Examiner* — Alvin Hunter

(57) ABSTRACT

The examples provided describe a golf club having a hollow rail member constructed to provide improved strength while reducing weight. The weight removed by using the hollow rail member may be redistributed to change club performance. Other embodiments may be described and claimed.

20 Claims, 7 Drawing Sheets

GOLF CLUB HEAD HAVING A HOLLOW RAIL MEMBER

TECHNICAL FIELD

The present disclosure relates generally to golf equipment, and more particularly, to methods, apparatus, and systems to custom fit golf clubs.

BACKGROUND

Industrial automation can provide many challenges in producing a product. Golf clubs are a particular challenge. Mass production tends to produce things that are uniform in design, quality and reliability, very well. However, golfers are not a very uniform group. Even if two players share many physical characteristics their swing, stance and the like can be quite different from each others. When personal differences are taken into consideration with the wide variety of the physical forms of players, designing a set of golf clubs that can be easily produced and can be custom fit for a variety of players having differing swings is a challenge.

Club customization is an effort to fit clubs to a player's individual needs. Manufactured clubs can be reworked, and clubs can be custom built. However, even custom built clubs may lack a sufficient degree of customization to satisfy golfers desiring to improve their game. Accordingly there may be a number of issues encountered in providing highly customizable golf clubs that perform well, are durable and are easy to manufacture.

BRIEF DESCRIPTION OF THE DRAWINGS

The present description will be better understood from the following detailed description read in light of the accompanying drawings, wherein.

Like reference numerals are used to designate like parts in the accompanying drawings.

DESCRIPTION

The detailed description provided below, in connection with the appended drawings, is intended as a description of the present examples, and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a golf club having a hollow rail member constructed with unique shaping to provide improved strength, while reducing weight, in particular when the hollow rail member is disposed on the top rail. The weight removed from in the rail member may be redistributed to change club performance.

Club strength may be improved in various ways, including selection of material for the hollow rail member, form of cross sectional profile, form of longitudinal profile, wall thickness, varying wall thickness, construction techniques, and the like.

Although the present examples are described and illustrated herein as being implemented in a system of fitting iron-type golf clubs, the system described is provided as an example and not a limitation. As those skilled in the art will appreciate, the present examples are suitable for application in a variety of different types of golf club systems including drivers, woods, putters, wedges, and the like.

Figure 1:
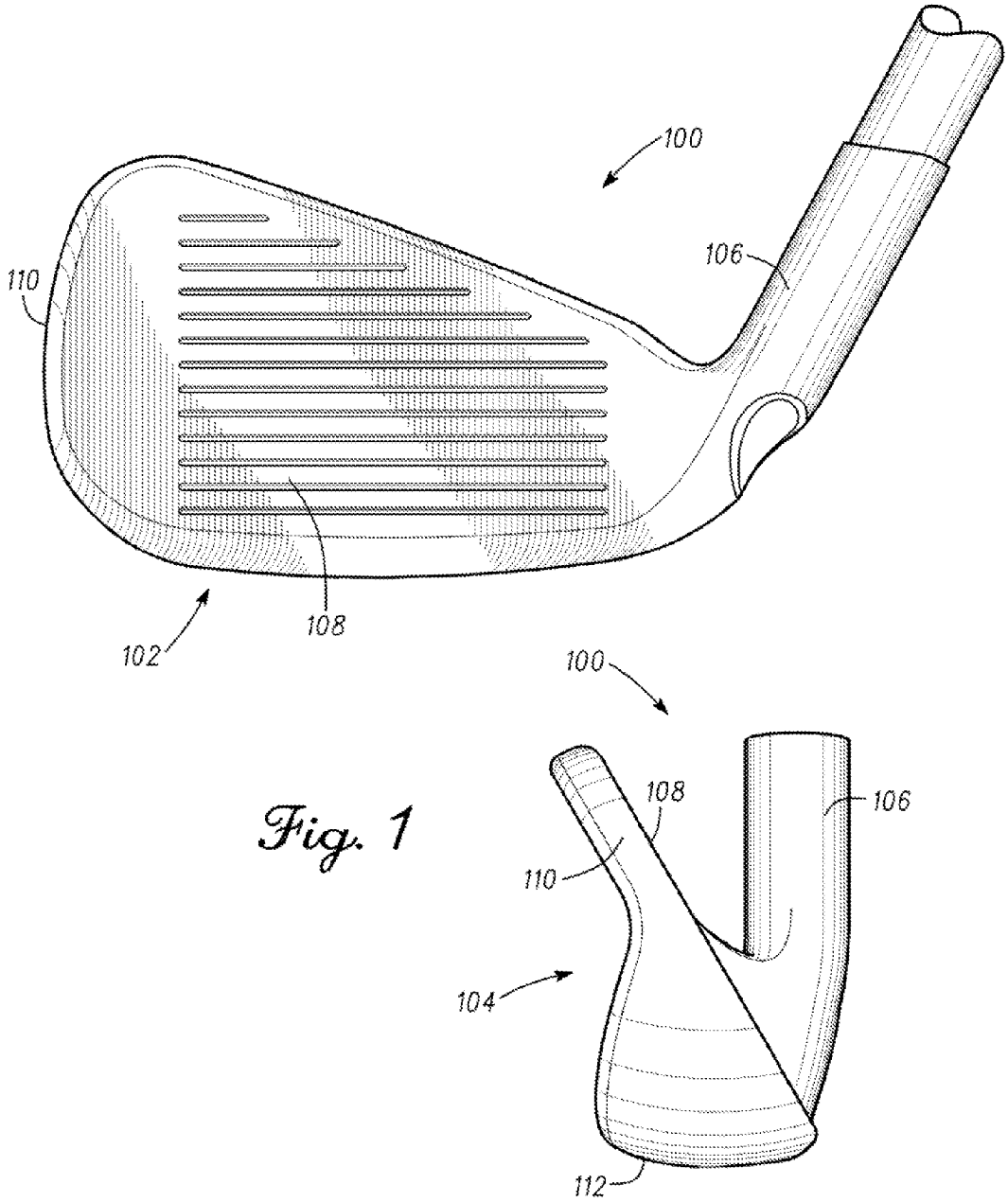
FIG. 1 shows an example iron-type golf club head.

FIG. 1 shows an example iron-type golf club head 100. The club head 100 is shown in a front view 102 and an end view 104. The club head 100 may be illustrative of golf club features in general as this iron-type golf club head includes a hosel 106, a face 108, a club body 110 and a toe 112. In clubs, the face 108 is typically reinforced by the club body 110 to provide a satisfactorily strong striking surface. However, it may be desirable to improve club strength and performance by redistributing body 110 weight.

Figure 2:
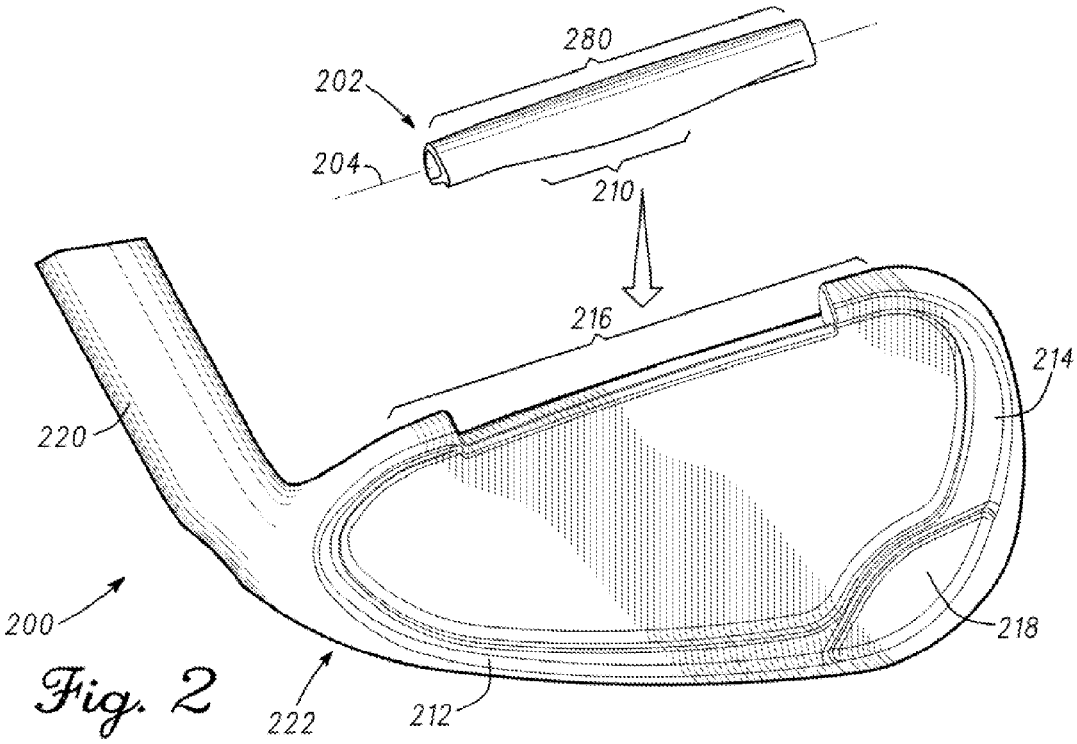
FIG. 2 shows an iron-type golf club head having a hollow top rail with weight redistribution.

FIG. 2 shows an iron-type golf club head having a hollow top rail member 202 allowing weight redistribution 200. This design may allow weight in the club to be freed up while maintaining strength and structural integrity of the club. The freed up weight may then be redistributed to other areas of the club which may increase the performance (i.e., increase moment of inertia, lower center of gravity, etc.) of the club, typically by moving the weight, or a portion thereof, to a lower position. Alternatively, for a lighter club, the weight, or a portion thereof need not be added back. For example weight may be moved, or redistributed to, any of the sole, toe or heel areas.

The hollow top rail member (or alternatively, top rail, hollow rail member tubular section, hollow top rail insert, specially constructed strengthening insert, hollow rail insert with strengthening section, or hollow rail with a reinforcing bulge) 202 may include a long axis 204 that substantially describes the overall length 208 of the hollow top rail member 202. In alternate examples it is understood that the "top" rail member 202 described below need not necessarily be disposed in a top position, as other positions may be possible. Thus the top position in which this specially constructed strengthening insert 122 is described is but an example of its use, or positioning. A strengthening section 210 may be provided over a portion of the long axis 204, or alternatively over the entire long axis 204. As shown the hollow top rail member 202 may be part of a reinforcing rail structure disposed about the perimeter on the back side 212 of the club face. One or more hollow rail members (e.g., the hollow top rail member 202) may be disposed along any portion of the perimeter 214 of the club 200. The hollow top rail member, need not be disposed in a "top" position to free up club weight, but may be disposed in any suitable position on the club. The hollow top rail member 202 may be integral to the club head 200, or a separate piece disposed in the club body. If constructed as a separate piece, the hollow top rail member 202 may extend through the body of the club head 200 to form a part of the club face, or it may be disposed on the back side 212 of the club face replacing a part of the rail section, and leaving the face as a unitary single piece. However, extending the hollow top rail member 202 through the face of the club head 200 tends to allow more material to be removed for more weight removal.

The hollow top rail member 202 may create discretionary weight by reducing the mass of the top rail 216 of the club head 200. This reduction in weight may be accomplished by hollowing out the top rail 216 and changing the shape in various dimensions to maintain or improve strength while allowing a weight reduction to be made. The change in shape of the top rail 216 does not simply remove weight. It also provides a strengthened structure (e.g., via the hollow top rail member 202) in compensation for materials removed as the change in shape tends to evenly distribute stress levels when a ball is hit.

In alternative examples, the hollow top rail member 202 could be made of a material with a higher strength than the club body 222. This allows for thinner walls with lighter weight while maintaining durability. This in turn would provide even more discretionary weight for redistribution to other areas of the club, such as the toe 218.

It may be desirable to remove the weight from the top rail 216 and position it lower on the club head 200 at an alternative location. For example more weight could be added to the toe 218, which produces a lower center of mass for the club head 200. Alternatively weight could be added to the hosel 220, or any other portion of the club head 200 desired.

Figure 3:
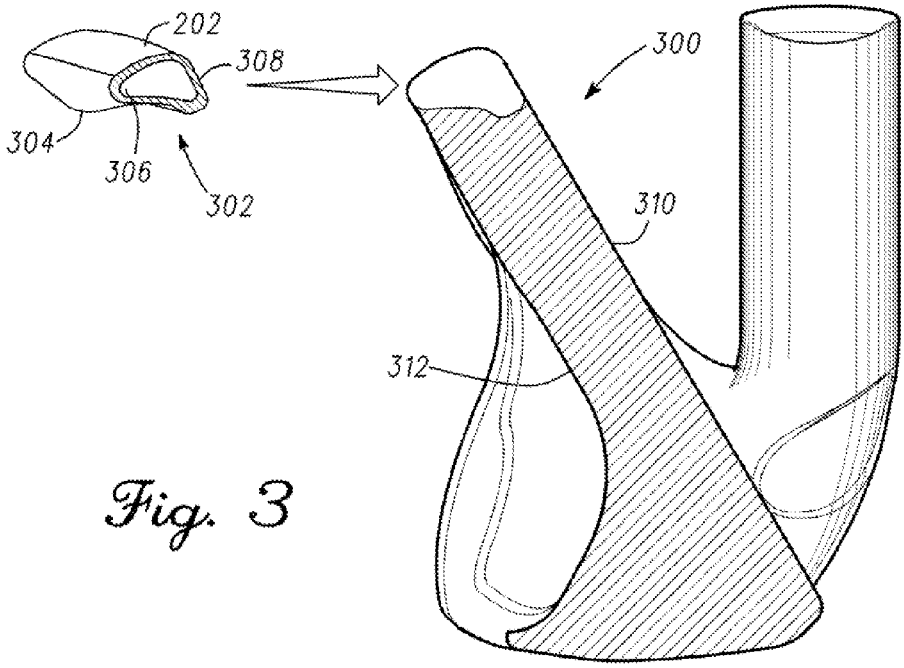
FIG. 3 shows the cross section detail of an exemplary hollow top rail of an iron-type golf club head having a hollow top rail member.

FIG. 3 shows the cross section detail of an exemplary hollow top rail of an iron-type golf club head 300 having a hollow top rail member 202. This view shows an exemplary cross sectional view 302 of the hollow top rail member 202. As shown, the top rail 202 is substantially hollow along its length. Along the length, a bulge 304 may be provided, typically in a central location or equivalent as desired to compensate for stress or otherwise strengthen the club head 300 during ball impact. The bulge 304 may extend downward, or alternatively in another direction, such as protruding in a rearward direction from the club head, or may point in any suitable direction.

The hollow top rail member 202 may include as part of its cross sectional area a stress dissipating portion 306, which may be known to be an area where stress is concentrated while hitting the ball. Providing an appropriate cross section 302, bulge 304, rail thickness, variation in rail thickness, and the like in this part can allow for providing a structure in the hollow top rail member 202 that allows strength to be maintained or improved, while allowing weight to be removed.

The face portion 308 of the cross sectional area 302 can form part of the club face 310, or may be coupled to the back side 312 of the club face 310 without forming a part of the club face 310. As such the unitary face can serve to couple and absorb stress from striking the ball, to the stress dissipating area 306 of the hollow top rail member 202.

Figure 4:
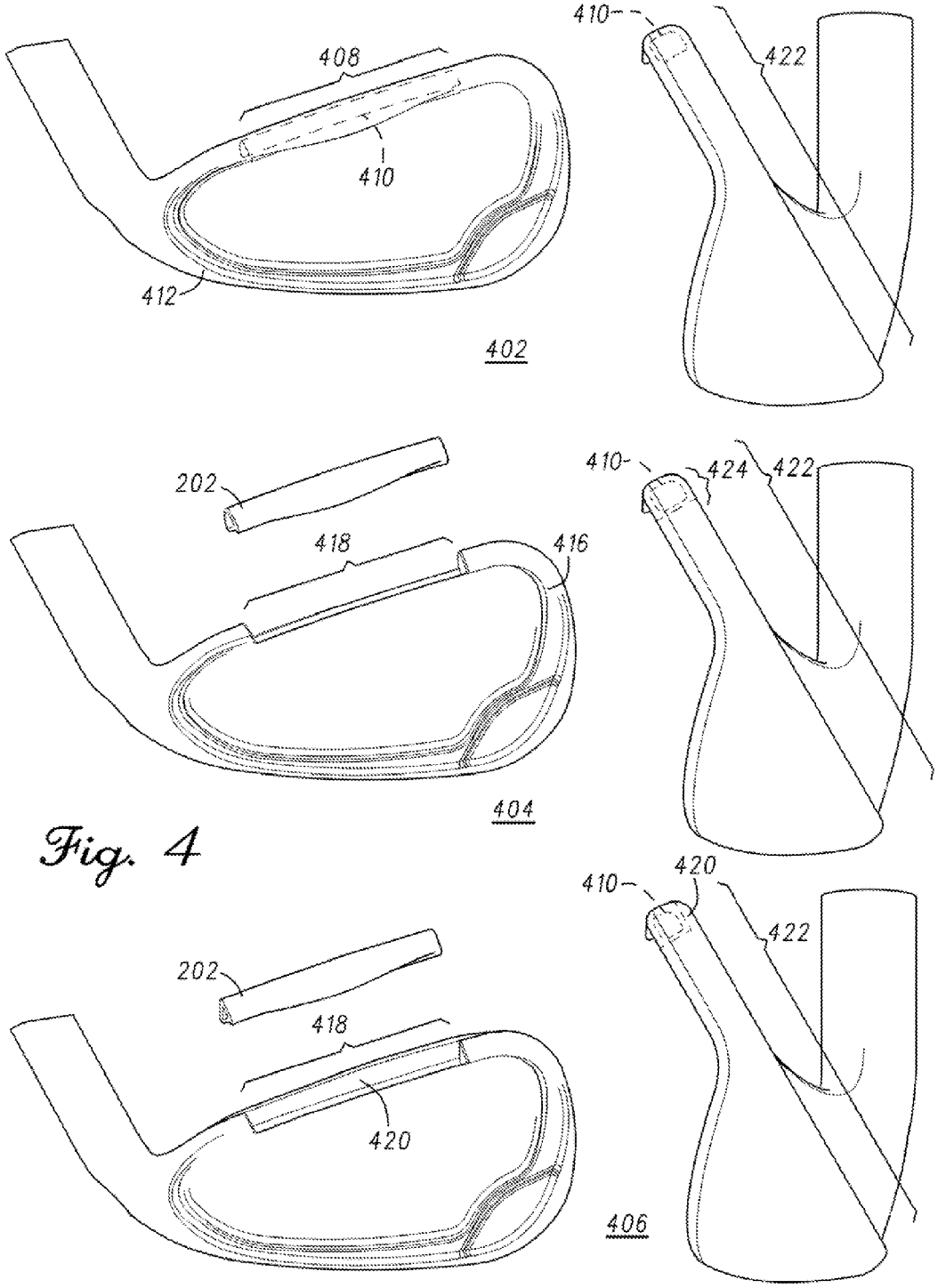
FIG. 4 shows three examples of disposing a hollow rail in an iron-type golf club head having a hollow top rail.

FIG. 4 shows three examples of disposing a hollow top rail member 202 in an iron-type golf club, to form clubs having a hollow top rail member 402, 404, 406. However, other configurations, or examples, utilizing the techniques described in this document may be constructed.

In the first exemplary configuration of a club head 402 the hollow top rail member 408 is constructed as an integral part of the club head. The club head 402 is shown in a view from the rear, to show the cavity 410 disposed in the hollow rail 408. Disposing a cavity 410 in the club head 402 may be accomplished by suitable casting, and machining or other equivalent techniques. A suitable alternative technique may include investment casting. The insertion of a ceramic core during the wax injection phase of investment type of casting can allow the creation of the cavity 410. One or more entry and exit holes may be provided so that the ceramic particles can be sand blasted out of the casting. These entry or exit holes can then be welded shut and suitable finishing provided to provide a smooth appearance.

The second exemplary configuration 404 and third exemplary configuration 406 may utilize a welded in or otherwise coupled tubular structure as a hollow top rail member 202. As shown in view 202 this process includes casting the club without a top rail 416, and leaving a let-out portion 418 of the top rail to later accept the hollow top rail member 202. A specially constructed part, or hollow top rail member 202 may be welded into the opening 418 and the welds ground and polished to provide a smooth surface. The formed hollow top rail member 202 may be investment cast, may be created by hydro forming, or by equivalent methods.

In the second exemplary configuration 404, the hollow top rail member 202 is included as part of the club face 422. This construction can allow for more weight savings as the face portion of the hollow top rail member 424 protrudes through to the face 422, and makes up part of the club face 422 typically thinning the assembled face thickness of the face portion of the hollow top rail member 424 due to the hollowed out cavity 410.

In the third exemplary configuration 406, the hollow top rail member 202 is disposed against the back side 420 of the club face 422. The hollow top rail member 202 is disposed against a ledge or thinned portion of the face 420. This configuration may not have as great a weight savings due to the cavity 410 typically being smaller. But the configuration 406 may allow for an integral face 422 to be provided.

The hollow top rail member 202 may be made from any suitably strong material that may be integrated into the assembly, including steel, aluminum, titanium, carbon composite materials, fiberglass and the like. The hollow top rail member or tube to club connection may also be assembled in alternative examples by interlocking or by snapping in or rotating in the part.

Figure 5:
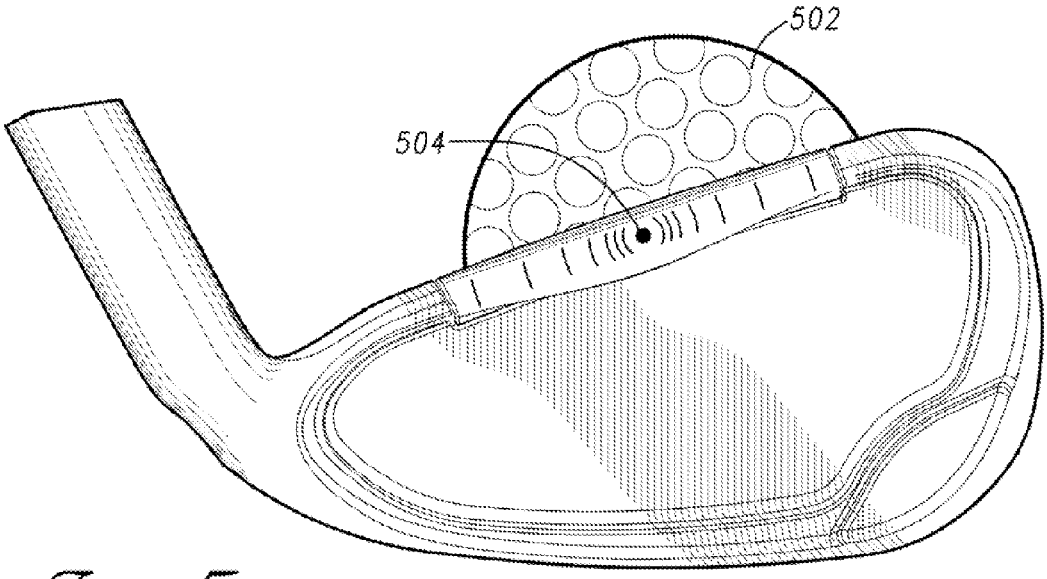
FIG. 5 is a diagram showing stress along the length of the top rail of an iron-type golf club head having a hollow top rail on hitting a golf ball.

FIG. 5 is a diagram showing stress along the length of the top rail of an iron-type golf club head having a hollow top rail in response to the club head striking a golf ball. Of particular interest is the relation of top rail design to the stress levels. The stress levels are results from dynamic finite element analysis which simulate a golf club impacting a golf ball 502. Near the center of the longitudinal axis of the top rail an area of higher stress is indicated 504 by close spaced lines, with a decreasing stress level indicated by an increase in line spacing. This area of higher stress 504 in the hollow top rail member may call for incorporation of a strengthening section having a bulge or other suitable shape to counteract the stress, and strengthen the club.

In addition, the walls of such a part could consist of varying thickness. The stress distribution during impact indicates that the stress is higher in the middle of the top rail and lower towards the ends. Therefore the tube walls could be made thinner on the ends. This creates additional discretionary weight that may be eliminated or moved to another location.

Figure 6:
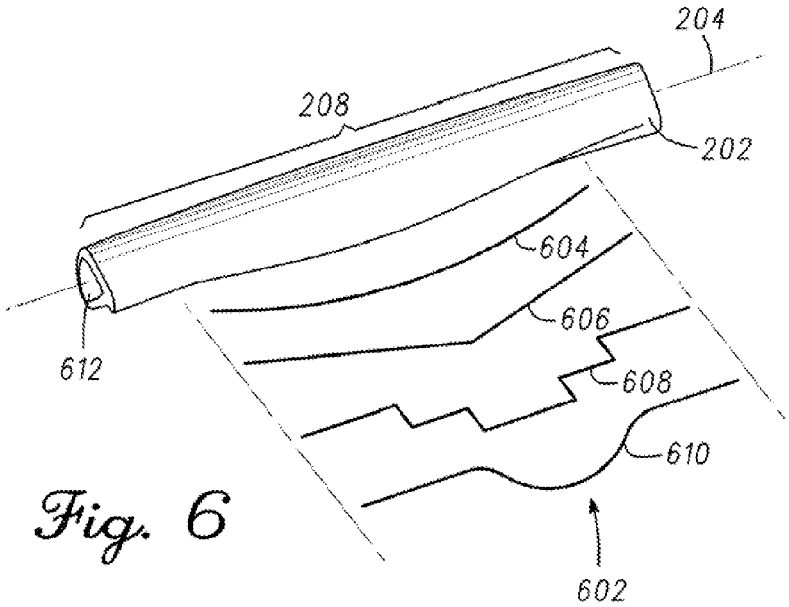
FIG. 6 shows an example of a hollow top rail insert.

FIG. 6 shows an example of a hollow top rail member 202. As shown the hollow top rail member 202 may include a strengthening section, or region 602 that may be provided in various shapes 604, 606, 608, 610. The external shapes may be formed as a bulge 604, a corner 606, a step 608, an exponential taper 610 or the like. The strengthening section may extend over a portion or all of the length 208 along the longitudinal axis 204 of the hollow top rail member 202. Alternatively the strengthening section 602 need not be positioned substantially centered along the length 208. The strengthening section 602 may be offset from center along the length 208, to provide an asymmetrical configuration. The interior cavity 612 of the hollow top rail member 202 may provide a varying thickness produced from an interior curvature differing from the outside curvature (variable wall thickness), a thickness tracking the curvature of the strengthening section (constant wall thickness), or the cavity width may be of a constant width 614 (as shown), creating a variable wall thickness. The variable wall thickness may provide additional support in the strengthening section. The strengthening section 602 may protrude in various directions, such as directly back (as show), or in equivalent directions such as up, down, or in any suitable position. The hollow top-rail member 202 may be constructed of any suitable material such as metal, non-metals, or the like.

Figure 7:
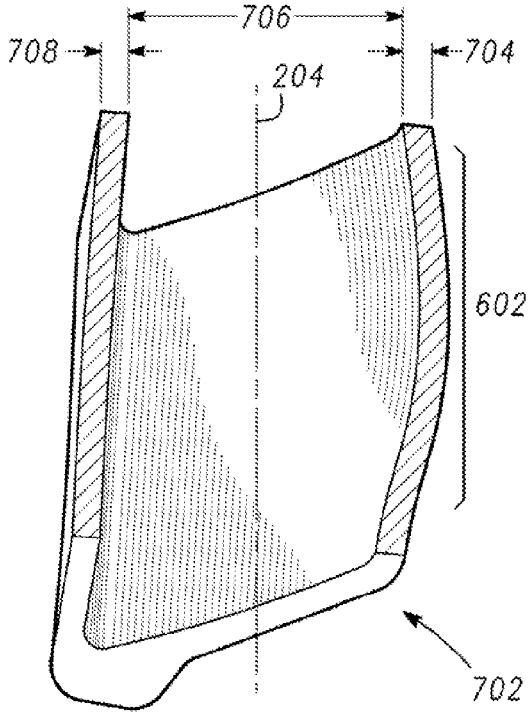
FIG. 7 shows a cross section of a constant thickness top rail.

FIG. 7 shows a cross section of a constant thickness top rail 702. As shown the wall thickness 704 is substantially constant and tends to follow the curvature of the outside strengthening section 602 of the top rail over the length of the strengthening section 602. In this example the cavity width 706 tends to vary. Also in alternative examples wall thicknesses 708, 704 need not be identical even in the constant thickness model.

Figure 8:
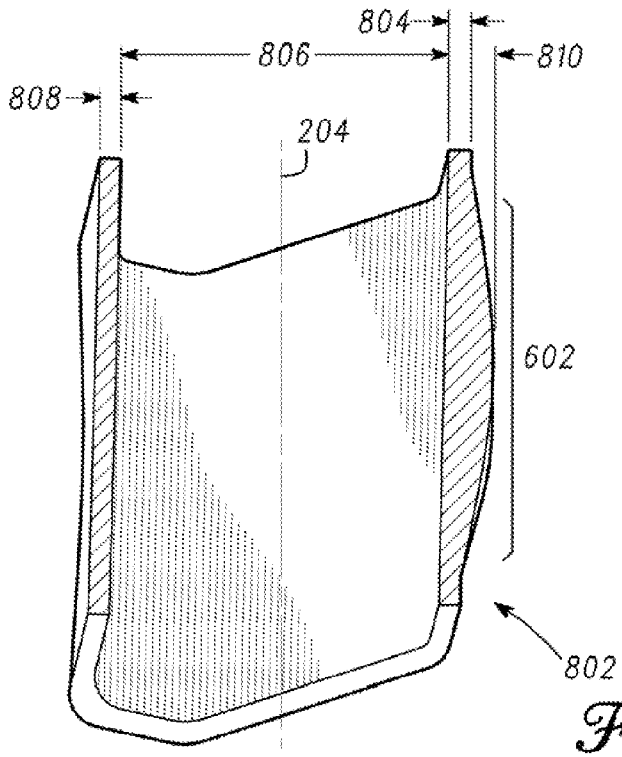
FIG. 8 shows a cross section of a variable thickness top rail.

FIG. 8 shows a cross section of a variable thickness top rail 802. As can be seen the width of the hollowed portion 806 is substantially constant with the outside wall curvature in the strengthening section 602 changing so that a variety of wall thicknesses 804, 810 may be formed. Also in alternative examples wall thicknesses 808 804 need not be similar.

Figure 9:
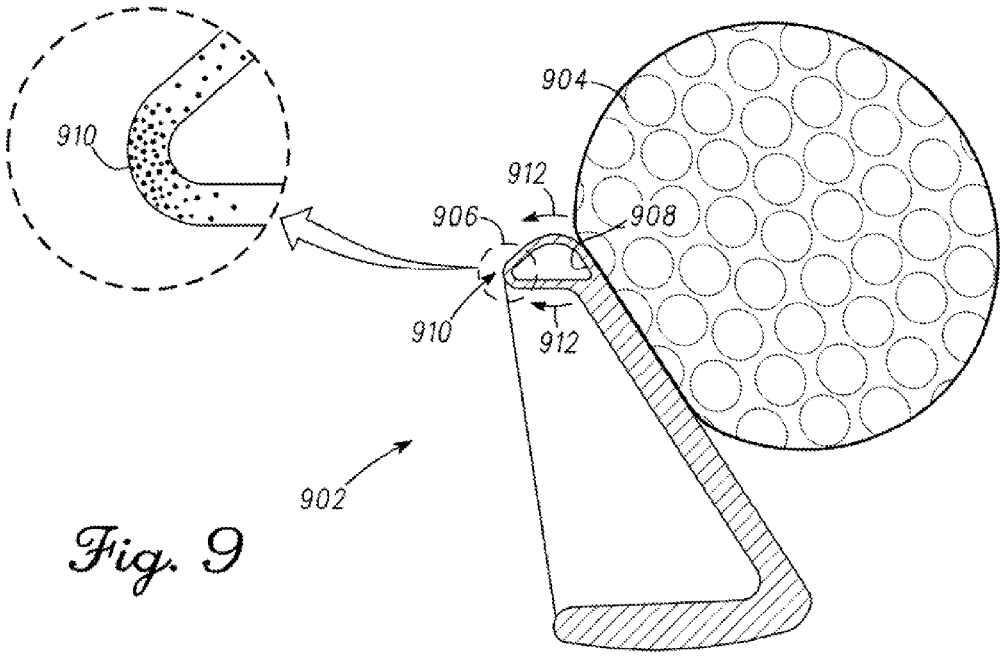
FIG. 9 is a diagram showing stress along a first exemplary cross-section of the top rail of an iron-type golf club head having a hollow top rail on hitting a golf ball.
Figure 10:
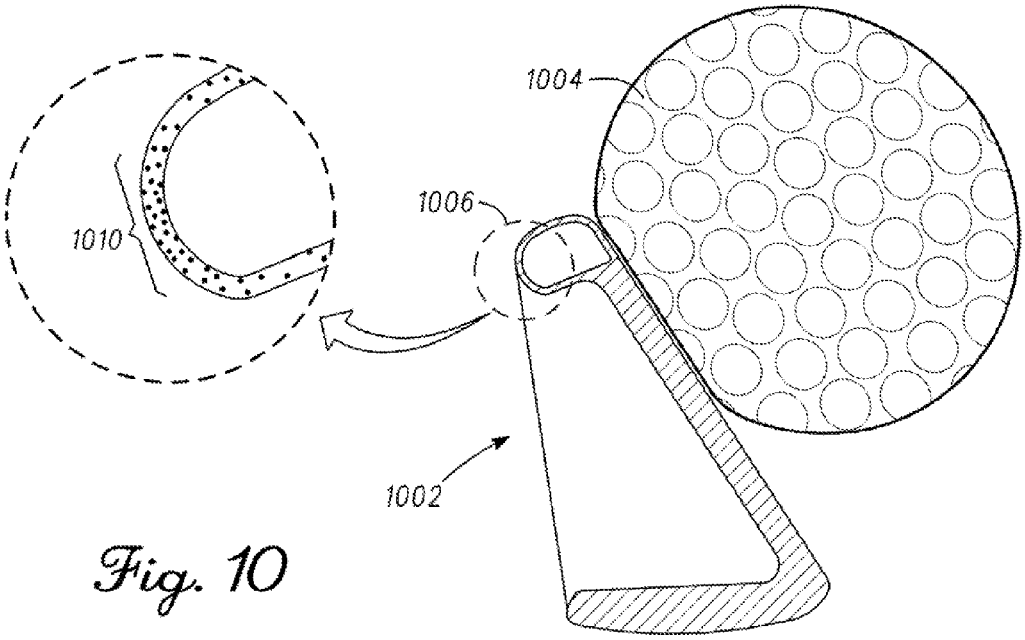
FIG. 10 is a diagram showing stress along a second exemplary cross section of the top rail of an iron-type golf club head having a hollow top rail on hitting a golf ball.

FIGS. 9 and 10 show finite element analysis simulations which compare two examples of hollow top rail construction and illustrate the effect on stress in the club from changing the shape of the top rail. The figures show moments in time when the stress levels on the club head are at their highest.

FIG. 9 is a diagram showing stress along a first exemplary cross section of the top rail of an iron-type club head having a hollow top rail 902 in response to the iron-type club head striking a golf ball 904. As can be seen in this diagram, the stress dissipating portion of the cross section 906 is somewhat small and pointed. As a result, stress may be transmitted 912 from striking a ball 904, through a face portion 908 of the hollow top rail 902 (or alternatively in the case where a hollow top rail member does not protrude through the club face the stress may be transferred first through the face of the club, then to the face portion 908). The transmitted stress 912 is then seen to be directed and concentrated in an area 910 in a stress dissipating portion of the cross section 906. Since the stress is ultimately transferred here this area may be advantageously strengthened in this area, as previously described.

FIG. 10 is a diagram showing stress along a second exemplary cross section of the top rail of an iron-type club head having a hollow top rail 1001 on hitting a golf ball 1004. Note that the area of high stress shown concentrated in the previous example (910 of FIG. 9) tends to be more spread out 1010. Also note the reduced stress levels as shown in FIG. 10 versus FIG. 9. These examples show the exemplary top rail of FIG. 10 having a greater area (provided by an exemplary balloon construction) which tends to be stronger than the exemplary top rail of FIG. 9, and tends to show through the shading that the geometric design has a noticeable impact on club durability. In this example of FIG. 10, the stress may be reduced by increasing the area of the stress dissipating portion of the cross section 1006, typically by increasing the hollowed out area cross section, or ballooning the structure.

Figure 11:
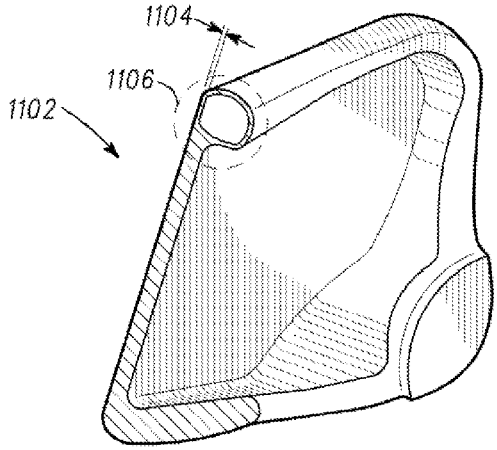
FIG. 11 shows an example of a balloon hollow top rail.

FIG. 11 shows an example of a balloon hollow top rail, generally shown as 1102. A first example hollow top rail 1102 includes an exemplary 0.020 inch thick hollow wall 1104, and a second example of the hollow top rail 1104 may include an exemplary 0.030 inch thick hollow wall 1104. Both hollow top rails variations 1102 are formed in a "balloon" cross sectional configuration 1106 to relieve stress in the part. Equivalent cross sectional configurations may be substituted having equivalent wall thicknesses 1104.

Figure 12:
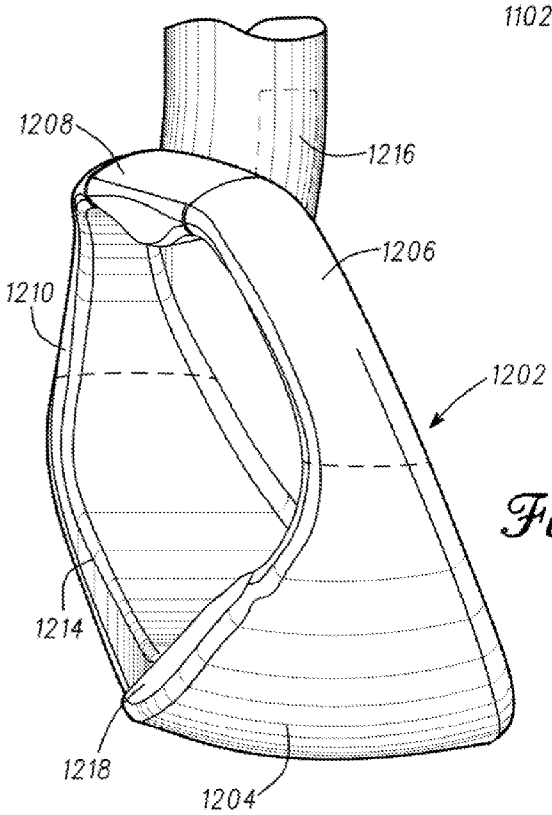
FIG. 12 is a diagram of an iron-type golf club head having a hollow rail with weight redistribution and including alternative sectional construction, to allow weight redistribution.

FIG. 12 is a diagram of an iron-type golf club head having a hollow rail (202 of FIG. 2, or alternatively a hollow top rail disposed in a position other than "top") with weight redistribution and including alternative sectional construction to allow weight redistribution 1202. In this example, weight removed from the club head may be added to the heel 1204. Alternatively, other sections of the club 1206, 1208, 1210, 1214, may be constructed as described for the hollow top rail so further weight may be redistributed (removed/added to other areas such as the toe 1204, the top rail 1208, the toe rail 1206, the sole rail 1214, the heel rail 1218, the hosel weight 1216 or the like. Fitting methods which may allow the assembly of interchangeable components, includes welding, epoxying, snap fit, or the like to couple a hollow top rail member to the various locations described above.

Figure 13:
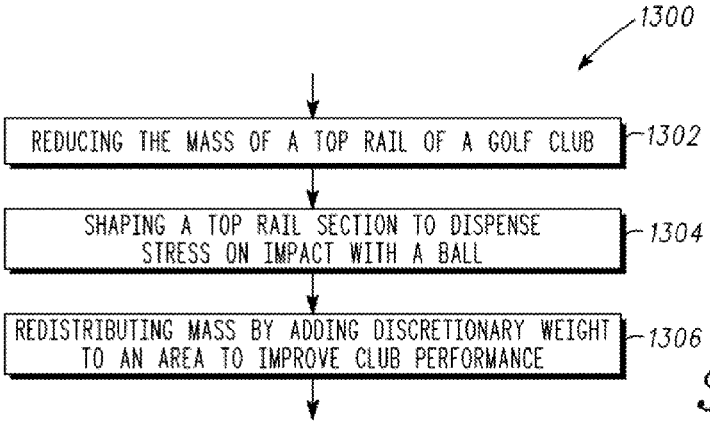
FIG. 13 is a flow diagram of a method for constructing a golf club.

FIG. 13 is a flow diagram of a method for constructing a golf club 1300. At block 1302 reducing the mass of a top rail of a golf club is performed. At block 1304, shaping a top rail back section to disperse stress on impact with a ball. In particular, the top rail back section may be elongated and may include a protrusion which may extend perpendicularly from the long axis of the top rail. Also, shaping the top rail back section may be performed to cause a constant rail thickness or alternatively a variable rail thickness.

At block 1306, redistributing or adding discretionary weight to an area to improve club performance may be performed. In particular, the discretionary weight is added to the toe, the hosel, or the like. Further, the center of gravity & moment of inertia tuning may be made by a combination of two or more connected or disconnected weights being arranged in differing configurations.

Those skilled in the art will realize that the process sequences described above may be equivalently performed in any order to achieve a desired result. Also, sub-processes may typically be omitted as desired without taking away from the overall functionality of the processes described above.

What is claimed is:

1. A club head comprising:

a club head body defining a top rail, a toe rail, a sole rail, and a heel rail, wherein the club head body is made of a first material, wherein only one of the top rail, the toe rail, the sole rail, and the heel rail is engaged to a hollow rail insert made of a second material that forms an enclosed hollow channel extending at least a portion of the hollow rail insert, wherein the first material and the second material are made of a different material.

2. The club head of claim 1, wherein the hollow rail insert has a variable wall thickness such that the hollow rail insert extends outwardly relative to at least one of the top rail, the toe rail, the sole rail, and the heel rail.

3. The club head of claim 1 in which the club head body comprises a toe portion having increased weight.

4. The club head of claim 1, wherein the top rail forms the hollow rail.

5. The club head of claim 1, wherein the sole rail forms the hollow rail.

6. The club head of claim 1, wherein the toe rail forms the hollow rail.

7. The club head of claim 1, wherein the heel rail forms the hollow rail.

8. A golf club comprising:

an elongated shaft; and a club head body engaged to the elongated shaft, the club head body defining a top rail, a toe rail, a sole rail and a heel rail, wherein only one of the top rail, the toe rail, the sole rail, and the heel rail is engaged to a hollow rail insert defining an enclosed hollow channel extending at least a portion of the hollow rail insert, wherein the hollow rail insert defines a bulging strengthening section that extends outwardly relative to the club head body in a generally elliptical curved configuration, wherein the bulging strengthening section extends in a direction between the heel rail to the toe rail.

9. The golf club of claim 8 in which the bulging strengthening section is integrally formed with the hollow rail insert.

10. The golf club of claim 8 in which the bulging strengthening section is disposed in a notch.

11. The golf club of claim 8 in which the bulging strengthening section is made from a material having improved strength.

12. The golf club of claim 8, wherein the top rail forms the hollow rail.

13. The golf club of claim 8, wherein the sole rail forms the hollow rail.

14. The golf club of claim 8, wherein the toe rail forms the hollow rail.

15. The golf club of claim 8, wherein the heel rail forms the hollow rail.

16. The golf club of claim 8, wherein the club head body is made of a fist material and the hollow rail insert is made of a second material.

17. The golf club of claim 16, wherein the first material and the second material are made of a different material.

18. A method of manufacturing a golf club head comprising:

forming a club head body defining a top rail, a toe rail, a sole rail, and a heel rail, wherein only one of the top rail, the toe rail, the sole rail, and the heel rail defines a cavity;

forming a hollow rail insert such that the hollow rail insert defines a bulging strengthening section that extends outwardly in a generally elliptical configuration; and engaging the hollow rail insert to the club head body such that the hollow rail insert and the cavity collectively form an enclosed hollow channel extending at least a portion of the hollow rail insert.

19. The method of claim 18, wherein the club head body is formed of a first material and the hollow rail insert is made of a second material that is a different type of material than the first material.

20. The method of claim 18, wherein the club head body and the hollow rail insert are made of the same material.

* * * * *